US005625330A

United States Patent [19]

Wilson et al.

[11] Patent Number: 5,625,330

[45] Date of Patent: Apr. 29, 1997

[54] RESONATOR COUPLING DEVICE WITH A ROTATABLE RING FOR ADJUSTING THE LOADED Q

[75] Inventors: William E. Wilson, Wainuiomata; Trevor J. Nixon, Tawa, both of New Zealand

[73] Assignee: Deltec New Zealand Limited, Tawa, New Zealand

[21] Appl. No.: 298,453

[22] Filed: Aug. 30, 1994

[30] Foreign Application Priority Data

Aug. 31, 1993 [NZ] New Zealand ..... 248549

[51] Int. Cl.[6] ..... H01P 7/06; H01P 5/04

[52] U.S. Cl. ..... 333/230; 333/245

[58] Field of Search ..... 333/230, 24 R, 333/245

[56] References Cited

U.S. PATENT DOCUMENTS

| | | | |
|---|---|---|---|
| 3,214,684 | 10/1965 | Everitt | 333/230 X |
| 4,249,147 | 2/1981 | Kaegebein | 333/230 X |
| 4,642,523 | 2/1987 | Nakanishi et al. | 333/230 X |
| 4,801,903 | 1/1989 | Mohr | 333/26 X |
| 4,980,662 | 12/1990 | Simon et al. | 333/230 X |
| 5,319,313 | 6/1994 | Vogel et al. | 333/99 S X |

FOREIGN PATENT DOCUMENTS

| | | |
|---|---|---|
| 1029435 | 5/1958 | Germany . |
| 820550 | 9/1959 | United Kingdom . |

*Primary Examiner*—Benny Lee
*Assistant Examiner*—Justin P. Bettendorf
*Attorney, Agent, or Firm*—Dvorak and Traub

[57] ABSTRACT

A coupling device for use in a resonator has a loop electrically connected at one end to a central conductor and at the other end to an electrically conductive ring wherein the loop may be rotated independently of the coupling device connector and mounting plate thereby allowing the loaded Q of the resonator to be varied without complete disengagement of the coupling device from the resonator.

2 Claims, 3 Drawing Sheets

RESONATOR COUPLING DEVICE WITH A ROTATABLE RING FOR ADJUSTING THE LOADED Q

FIELD OF THE INVENTION

This invention relates to a coupling device for use in a resonator. More particularly the invention relates to a loop-coupled device consisting of a loop which projects into the cavity of a resonator and may be adjusted to change the loaded Q of a resonator for matching purposes.

BACKGROUND OF THE INVENTION

Referring firstly to FIG. 1 a resonator 1 is shown having a central conductor 1*a* and loop-coupled devices 2 and 3 engaged therewith. Co-axial lines 4 and 5 carry signals to and from loop devices 2 and 3. By rotating loops 6 and 7 the loaded Q of the resonator may be varied. Loops 6 and 7 are rotated in concert i.e., each loop being disposed at the same angle to a line passing through the centers of the loops to ensure that the correct impedance is obtained at both the input and output ports.

Referring now to FIGS. 2 and 3 a typical prior art loop-coupled device is shown. Connector 8 consists of a body portion 9 connected as its base to a mounting plate 10. A central conductor 11 is held co-axial with and electrically isolated from body 9 by insulating material 12. A loop 13 is electrically connected at one end to central conductor 11 of the connector and at the other end to mounting plate 10.

As can be seen in FIG. 3 the mounting plate 10 is provided with a number of elongate slots 14 around its periphery. The mounting plate 10 is fastened to the top wall 15 of a resonator by screws 16.

In use, the connector is placed within aperture 17 of wall 15, the screws are placed through the slots 14 and loosely screwed into wall 15. The connector may be rotated to achieve the desired loaded Q factor. When in the desired position screws 16 may be fastened to hold the connector in place and provide electrical contact.

This design has two major drawbacks. Firstly, the slots reduce the strength of the mounting plate 10 adjacent screws 16 and limit the degree of force that can be applied between mounting plate 10 and wall 15. This may result in a poor contact being formed between mounting plate 10 and wall 15, resulting in unwanted intermodulation frequencies. Further, connection and disconnection of connectors to connector 8 may result in rotation of the connector relative to wall 15, which may alter the loaded Q factor from its tuned value.

It is an object of the present invention to provide a coupling device which mitigates the above disadvantages or at least provide the public with a useful choice.

SUMMARY OF THE INVENTION

According to one aspect of the invention there is provided a coupling device for a resonator comprising:

a connector having a mounting plate at the base thereof and a cylindrical portion extending below said base, said plate being provided with a plurality of apertures around the periphery thereof to enable said plate to be mounted to a wall of a resonator by suitable fastening means;

an electrically conductive ring rotatable about said cylindrical portion; and a loop electrically connected at one end to a central conductor of said connector and at the other end to said ring, said loop, ring and central conductor being rotatable relative to the cylindrical portion.

BRIEF DESCRIPTION OF THE DRAWINGS

The invention will now be described by way of example with reference to the accompanying drawings in which.

Figure 1:
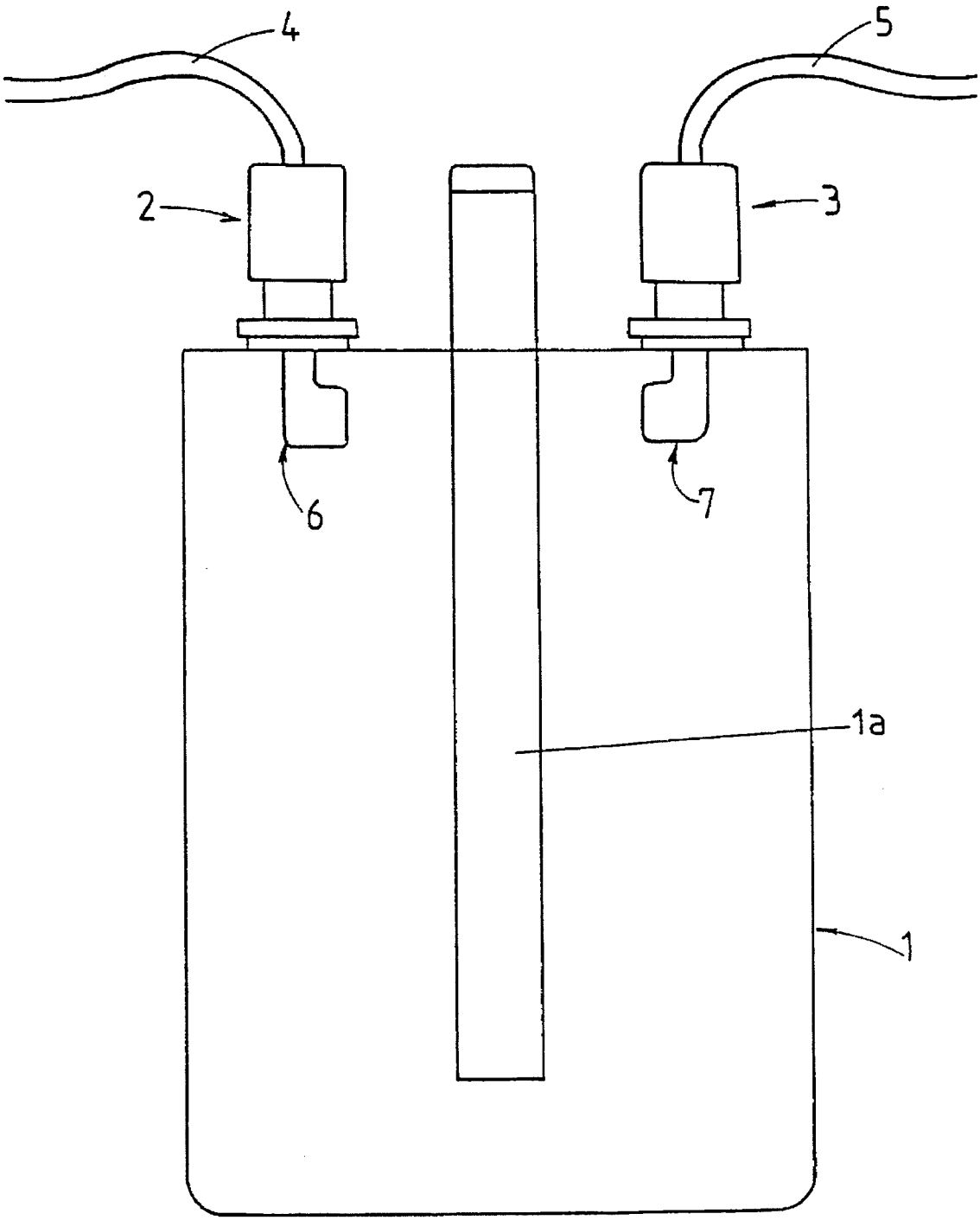
FIG. 1 Prior Art
FIG. 1: shows a prior art resonator.
Figure 2:
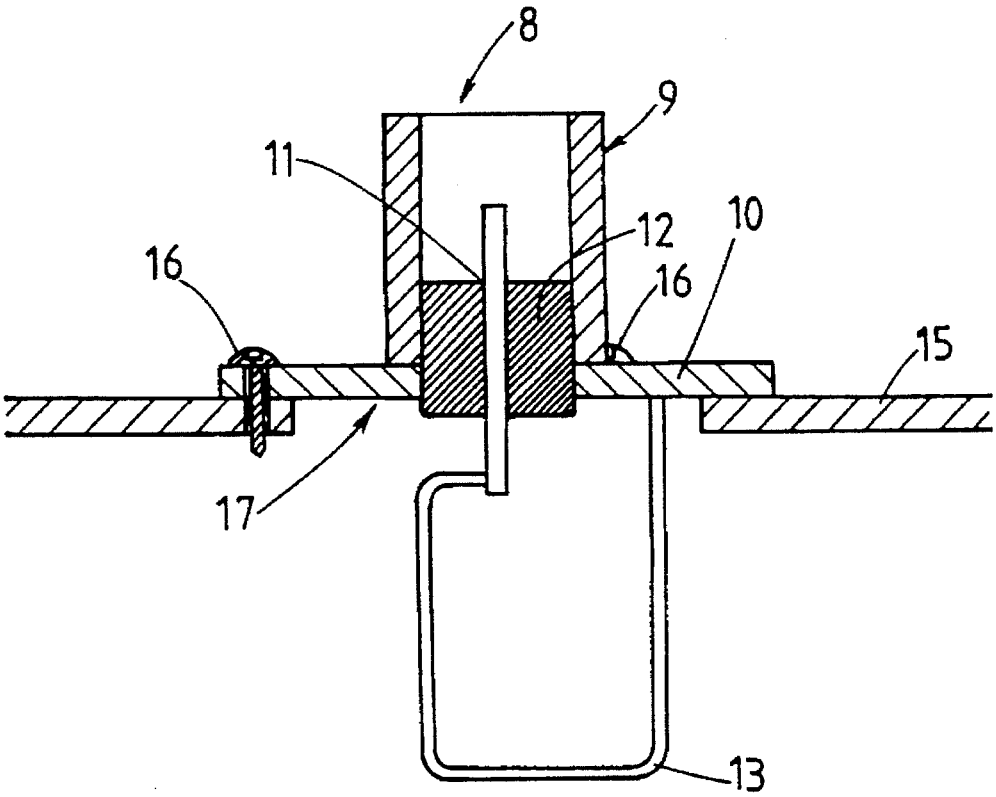
FIG. 2 Prior Art
FIG. 2: shows a side cutaway view of a prior art loop-coupled device.
Figure 3:
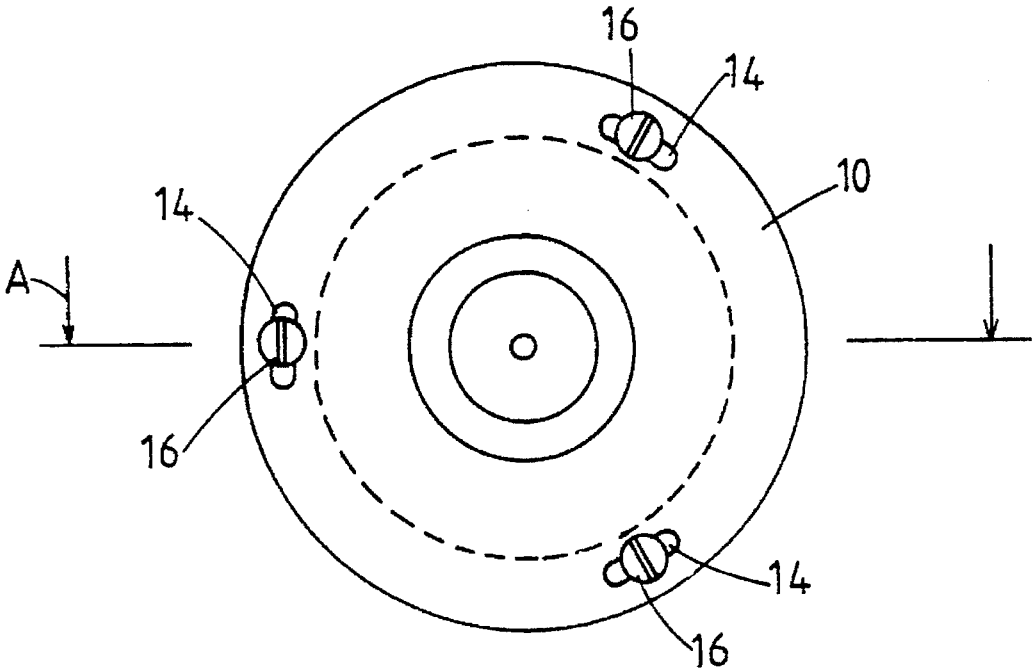
FIG. 3 Prior Art
FIG. 3: shows a top view of the prior art loop shown in FIG. 2.
Figure 4:
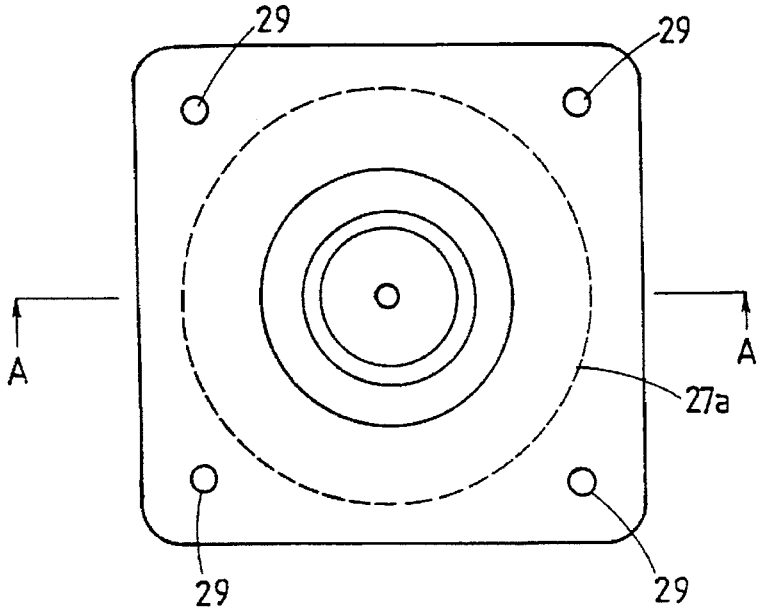
FIG. 4: shows a plan view of a coupling device according to a preferred embodiment of the invention.
Figure 5:
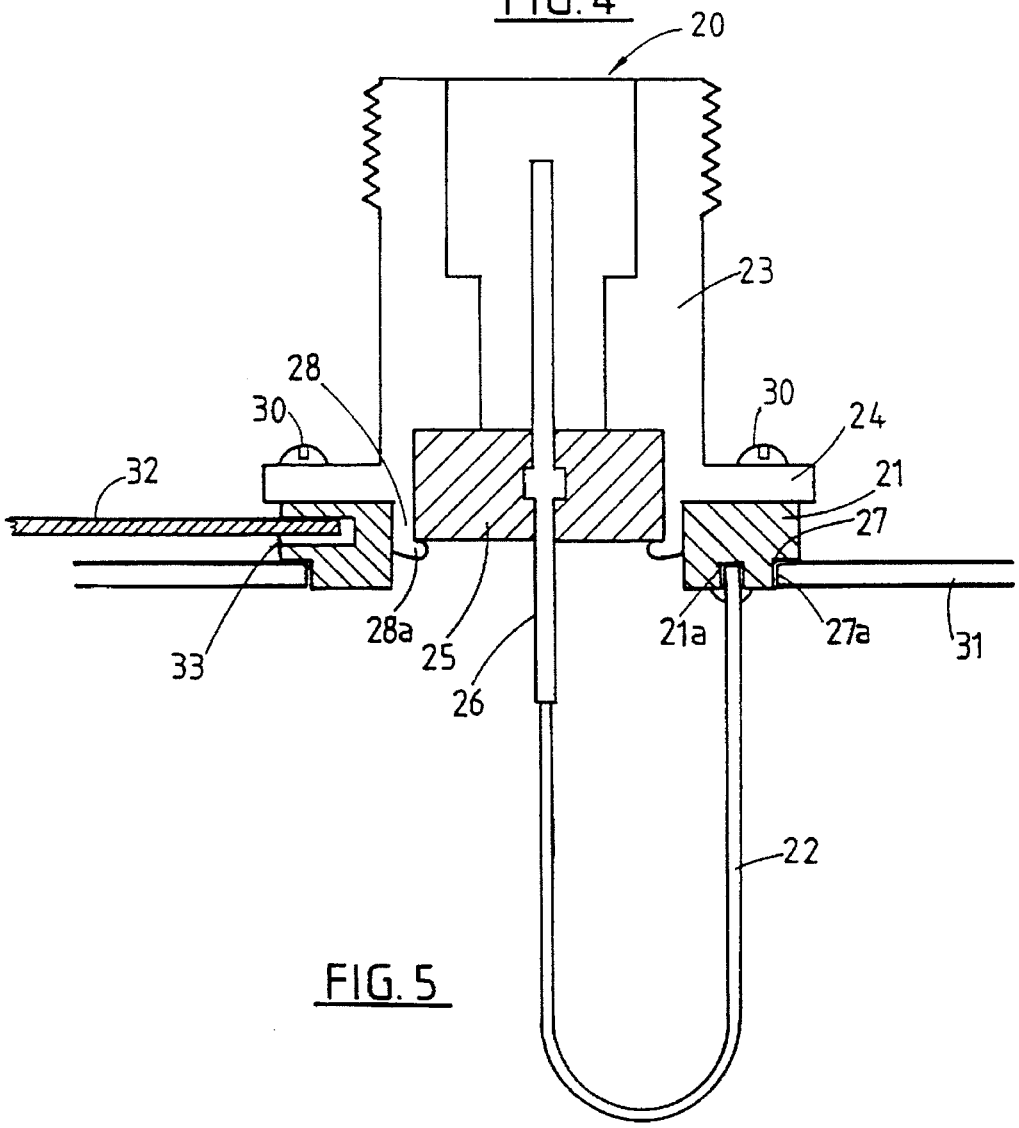
FIG. 5: shows a cross-sectional view through line A—A of the device.

Turning attention to FIGS. 4 and 5, a coupling device of the invention consists of a connector 20, a ring 21 and a loop 22. Connector 20 includes a body portion 23 connected to a mounting plate 24 at its base. A block of insulating material 25 supports a central conductor 26 of connector 20. Insulating disc 25 is retained by overturned edges 28*a* of cylindrical portions 28.

Loop 22 is electrically and mechanically connected to central conductor 26 at one end and ring 21 at the other. Loop 22 is preferably formed from a strip of sheet metal and is soldered in a slot 21*a* in ring 21. Insulating disc 25 holds central conductor 26 in fixed position relative to body 23, although allowing rotation of central conductor 26 relative to body 23. Ring 21 is held in the position shown in FIG. 5 by loop 22 when the connector is not secured to a resonator.

Referring now to FIG. 4 the device may be seen in plan view. The dashed outline 27*a* shows the edge of the aperture provided in the top wall of the resonator. Ring 21 is provided with an annular recess 27. In use the device is placed within the aperture in the top wall of the resonator so that the edge 28 of the top wall locates within recess 27. Screws 30 are then placed through apertures 29 of mounting plate 24 and are screwed into top wall 31. Initially the screws are only loosely tightened. Ring 21 is provided with at least one blind 33 therein. A shaft 32 may be placed within bore 33 and moved clockwise or anti-clockwise (in plan) to rotate ring 21 relative to body 23 of connector 20. When ring 21 is rotated, loop 22 also rotates, which rotates which central conductor 26 relative to body portion 23. Central conductor 26 is free to rotate relative to body portion 23 and ring 21 is free to rotate relative to cylindrical portion 28. Accordingly, the loaded Q factor of the resonator may be adjusted by rotating ring 21 while the screws are loosely fastened. A number of bores 33 may be provided for ease of adjustment.

Once the position of loop 22 has been adjusted to obtain the required loaded Q factor screws 30 may be tightly fastened to secure the connector to the top 31 of the resonator. When screws 30 are fastened mounting plate 24 is forced against ring 21 which in turn is forced against top wall 31. The arrangement enables high force to be applied between mounting plate 24, ring 21 and top wall 31. This results in good electrical contact and reduces unwanted intermodulation frequencies. Further, the arrangement does not permit rotation of the connector 20 (and thus loop 22) relative to top wall 31 as connectors are connected to or disconnected from connector 20.

Wherein in the foregoing description reference has been made to integers or components having known equivalents then such equivalents are herein incorporated as if individually set forth.

Although this invention has been described by way of example it is to be appreciated that improvements and/ or modifications may be made thereto without departing from the scope or spirit of the invention.

What is claimed is:

1. A coupling device for use in a resonator having a top wall that includes a circular aperture therethrough and an edge defined by said aperture, comprising:

a connector having a body portion, a base and a cylindrical portion extending below said base;

a mounting plate having a periphery, said plate being provided with a plurality of apertures around the periphery thereof to enable said plate to be mounted to said top wall of said resonator by suitable fastening means;

an electrically conductive ring having a central bore therein and an annular recess which bits into said top wall edge, said ring encompassing said cylindrical portion of said connection and being rotatable about said cylindrical portion, said ring provided with at least one radial blind bore providing a recess in which a shaft is inserted therein to enable clockwise and counterclockwise rotation of said ring relative to said cylindrical portion of said connector, said radial blind bore penetrating into said ring in a direction normal to the central bore; and a conductive loop having a pair of ends, one end electrically and rotatably connected to said central conductor of said connector and said other end attached to said ring, wherein said loop, said ring and said central conductor are rotatable relative to the cylindrical portion.

2. A resonator having a top wall with an aperture therethrough that defines an edge of said wall, said resonator capable of adjustment of a loaded Q factor, said resonator comprising:

a coupling device extending through said aperture and mounted to said top wall, said coupling device comprised of a connector having a base, a body portion, and a cylindrical portion which extends below said base;

a mounting plate connected to the coupling device and secured directly to the resonator top wall by fastening means;

an electrically conductive ring having a central bore therein and an annular recess which fits into said top wall edge, said ring encompassing said cylindrical portion of said connector and further including at least one radial blind bore extending into said ring normal to said central bore;

a conductive loop having a pair of ends, one end electrically and rotatably connected to said central conductor of said connector and said other end attached to said ring, wherein said loop, said ring and said central conductor are rotatable relative to the cylindrical portion of said connector when a removable shaft is inserted within said radial blind bore and manipulated so as to rotate said ring in one of a clockwise or counterclockwise direction when adjusting said loaded Q factor of the resonator.

* * * * *